US011214989B2

(12) United States Patent
Dragon et al.

(10) Patent No.: US 11,214,989 B2
(45) Date of Patent: Jan. 4, 2022

(54) MOTOR VEHICLE LOCK

(71) Applicant: Kiekert AG, Heiligenhaus (DE)

(72) Inventors: Marek Dragon, Waldbröl (DE); Alexander Grossmann, Essen (DE); Thomas Waldmann, Mülheim an der Ruhr (DE)

(73) Assignee: Kiekert AG, Heiligenhaus (DE)

( * ) Notice: Subject to any disclaimer, the term of this patent is extended or adjusted under 35 U.S.C. 154(b) by 923 days.

(21) Appl. No.: 15/764,992

(22) PCT Filed: Dec. 9, 2015

(86) PCT No.: PCT/DE2015/100525

§ 371 (c)(1),
(2) Date: Jul. 26, 2018

(87) PCT Pub. No.: WO2017/054790

PCT Pub. Date: Apr. 6, 2017

(65) Prior Publication Data

US 2019/0055754 A1 Feb. 21, 2019

(30) Foreign Application Priority Data

Oct. 2, 2015 (DE) ..... 10 2015 116 805.7

(51) Int. Cl.
*E05B 77/04* (2014.01)
*E05B 85/02* (2014.01)
*E05B 77/10* (2014.01)

(52) U.S. Cl.
CPC ..... *E05B 77/04* (2013.01); *E05B 77/10* (2013.01); *E05B 85/02* (2013.01)

(58) Field of Classification Search
CPC ..... E05B 77/04; E05B 77/10; E05B 85/02
(Continued)

(56) References Cited

U.S. PATENT DOCUMENTS 6,422,616 B1 * 7/2002 Wortmann ..... E05B 83/24 292/214
6,474,705 B1 * 11/2002 Mori ..... E02F 9/2004 292/216

(Continued)

FOREIGN PATENT DOCUMENTS

DE 10115667 A1 10/2002
DE 10 2010 002 736 A1 9/2011

(Continued)

OTHER PUBLICATIONS

International Search Report and Written Opinion for corresponding Patent Application No. PCT/DE2015/100525 dated Jun. 17, 2016.

*Primary Examiner* — Kristina R Fulton
*Assistant Examiner* — Tal Saif
(74) *Attorney, Agent, or Firm* — Renner, Otto, Boisselle & Sklar, LLP

(57) ABSTRACT

A motor vehicle lock includes a catch, a pawl, and a latch plate, wherein the catch and the pawl are rotatably supported on the latch plate, the latch plate has at least two openings for mounting the motor vehicle lock, and the latch plate has an inlet slot for a latch holder, and wherein a splay lying opposite the inlet slot is provided on the latch plate, wherein the splay has the form of a semicircle at least in an end region opposite the inlet slot.

12 Claims, 5 Drawing Sheets

(58) Field of Classification Search
USPC ..... 292/194
See application file for complete search history.

(56) References Cited

U.S. PATENT DOCUMENTS

| | | | | |
|---|---|---|---|---|
| 7,264,283 | B2 * | 9/2007 | Stoof | E05B 17/04 292/201 |
| 2003/0094024 | A1 * | 5/2003 | Dimig | E05B 83/36 70/277 |
| 2007/0182165 | A1 * | 8/2007 | Yoshikuwa | E05B 83/36 292/216 |
| 2007/0257496 | A1 * | 11/2007 | Spurr | E05B 81/14 292/57 |
| 2007/0278802 | A1 | 12/2007 | Hanisch | |
| 2009/0230700 | A1 * | 9/2009 | Arabia | E05B 77/06 292/93 |
| 2015/0204118 | A1 * | 7/2015 | Cetnar | E05B 81/36 292/197 |

FOREIGN PATENT DOCUMENTS

| | | | | |
|---|---|---|---|---|
| DE | 10 2011 076 704 | A1 | 12/2012 | |
| DE | 10 2012 211898 | A1 | 1/2013 | |
| DE | 102012211898 | A1 * | 1/2013 | E05B 81/66 |
| DE | 20 2012 007 326 | U1 | 11/2013 | |
| EP | 2 792 829 | A2 | 10/2014 | |
| EP | 2792829 | A2 * | 10/2014 | E05B 81/66 |
| FR | 2937071 | A1 | 4/2010 | |
| JP | 2013002182 | | 1/2013 | |
| JP | 2013019183 | | 1/2013 | |
| WO | WO-2010054860 | A2 * | 5/2010 | B60N 2/433 |
| WO | 2014172187 | A1 | 10/2014 | |

* cited by examiner

MOTOR VEHICLE LOCK

TITLE OF DISCLOSURE

Field of Disclosure

The invention relates to a motor vehicle latch having at least a catch, a pawl and a latch plate, the catch and the pawl being pivotably mounted on the latch plate, the latch plate has at least two openings for mounting of the motor vehicle latch, the latch plate having an inlet slot for a latch holder and a splay opposite the inlet slot being provided for on the latch plate.

BACKGROUND OF DISCLOSURE

Latches which retain the moving parts on the motor vehicle in their specified position are used to close motor vehicle doors, flaps or sliding doors, to name just a few examples. Normally, the latch systems or latches have a locking mechanism, consisting of a catch and at least a pawl which can be ratcheted into one another in order for example to encompass a latch holder attached to the motor vehicle chassis in order to, for example, retain a motor vehicle door in its position. The locking mechanism, catch and pawl are pivotably mounted on a latch plate, wherein the latch plate and the locking mechanism part axes incorporating the locking mechanism parts are made of metal, in particular steel. Due to the locking mechanism and the bearing parts of the latching system being made of steel, the latching system or motor vehicle latch is capable of guaranteeing sufficient safety, even in extreme situations. Extreme situations for a latching system of a motor vehicle occur, for example, in the case of an accident, whereby the latching systems can be stressed beyond a multiple of the usual stresses.

In order to guarantee sufficient safety in these extreme situations too, tensile tests are performed in which the motor vehicle latches are subjected to a stress occurring in an accident. Under these simulated extreme conditions, the motor vehicle latches are subjected to tensile stress until failure of the locking mechanism. Failure means, for example, during tensile stress between the latch holder and the locking mechanism in the direction of the locking mechanism plane the latching unit comprising a motor vehicle latch and a latch holder are pulled apart until failure occurs of one of the components of the motor vehicle latch and/or the latch holder. To enable a latching unit to be used in the motor vehicle the latching unit must withstand tensile stress above the specifications of the car manufacturer before failure of one or several components of the latching unit occurs.

In order to conform to the requirements of the motor vehicle manufacturer, different solutions have become known to stabilize a latch plate or a motor vehicle.

DE 20 2012 007 326 U1 discloses a motor vehicle latch with a latch case, furthermore with a locking mechanism mounted in the latch case comprising a catch and a pawl and with an additional reinforcing element, where the reinforcing element is formed as a reinforcing plate connecting both rotational axes of both the catch and the pawl at a distance from the latch case. The latch case or the latch plate, it being pointed out that the latch case and latch plate can be used as synonyms, is U-shaped in the cross-section. As the legs of the U-shaped latch case are arranged fundamentally vertically to the motor vehicle transverse direction or y-direction, the specification of the latch case ensures that the rectangular supporting structure is arranged vertically to this y-direction. Any forces in this motor vehicle transverse direction are thus absorbed by the locking mechanism or the supporting structure and are passed into the latch case. The latch case and reinforcing plate hereby form a storage cage for the locking mechanism. Consequently, deformation forces can be resiliently absorbed in the case of a crash.

It is also known and, for example, described in DE 10 2010 002 736 A1 to form the latch case as an L-shape. The long arm of the L-shaped latch case hereby forms the base plate to accommodate the locking mechanism, wherein the short arm of the L-shaped latch case encompasses the inlet area of the latch holder in the lengthwise direction of the vehicle and has a stabilizing effect. Furthermore, an additional latch case wall opposite the short L-leg is provided for from this publication. The latch case thus has a base surface and two lateral walls. The lateral walls of the latch case include the base surface in a right angle. If two lateral walls are provided for which are opposite one another then the latch case is U-shaped. If no lateral walls exist, a latch plate is also referred to.

If a latch case is referred to generally hereafter, this should also encompass a latch plate.

From DE 10 2011 076 704 A1 in turn a U-shaped latch case is known, whereby the lateral wall opposite the inlet slot is arch-shaped. The arch shape has an axis for a leg spring and attaches the axis or holds the axis of the leg spring in the correct position in relation to the locking mechanism components.

A problem always posed in the further development of motor vehicle latches is that on the one hand safety which fulfills requirements needs to be guaranteed to enable the specified stress limitations to be attained. On the other hand, the automotive industry is striving to make motor vehicles lighter overall.

SUMMARY OF DISCLOSURE

The task of the invention is to provide an improved motor vehicle latch. Furthermore, the task is to provide a motor vehicle latch which conforms to the safety requirements and stresses of the automotive industry and is simultaneously lightweight. Furthermore, it is a task of the invention to provide a cost-effective motor vehicle latch of a simple construction.

The task is solved according to the invention due to the characteristics of the disclosure. Advantageous configurations of the invention are specified in the disclosure. It is pointed out that the exemplary embodiments described hereafter are not restrictive; instead, any possible variations are possible of the characteristics described in the description.

According to the disclosure, the task of the invention is solved by a motor vehicle latch being provided having at least a catch, a pawl and a latch plate, where the catch and the pawl are pivotably mounted on the latch plate, the latch plate having at least two openings for mounting of the motor vehicle latch, the latch plate having an inlet slot for a latch holder, where a splay opposite the inlet slot is provided for on the latch plate and where the splay has at least a semi-circular end area opposite the inlet slot. The design of the motor vehicle latch according to the invention now gives the option of providing an improved motor vehicle latch which can absorb the highest stresses with the lightest weight. Essentially, the splay in the end area of the latch plate opposite the inlet slot has a stabilizing effect on a tensile load.

If a motor vehicle latch is spoken about in the context of the invention, lateral door latches, sliding door latches, hood latches and also tailgate latches are meant. All of those motor vehicle latches can be exposed to extreme stresses, as can occur in an accident, for example. The invention preferably relates to motor vehicle latches with a catch and at least a pawl which are arranged engaging into one another on a joint latch plate, i.e. a basically flat base plate. The catch and the at least one pawl form a locking mechanism which interacts with a latch holder or locking bolt. If a latch holder is referred to in relation to the invention, this hereby means on the one hand a bracket-shaped latch holder and also a locking bolt designed as a bolt. The latch holder can be mounted on the chassis and the motor vehicle latch mounted on a lateral door, for example. However, a relevantly reverse mounting is also possible. The catch and the pawl form the locking mechanism and are mounted in a plane parallel to the latch plate in a pivoting manner on the latch plate.

On an open motor vehicle latch, an infeed section of the catch lies opposite the latch holder. Consequently, when the motor vehicle latch is closed the latch holder can engage with the catch. Consequently, the latch holder is able to rotate or pivot the catch and hold the catch in its ratchet position in a closure position of the motor vehicle latch. A stress direction of the motor vehicle latch lies in the motor vehicle transverse direction, for example. A direction transverse to the motor vehicle is also named Y-direction. If the motor vehicle latch relates to a lateral door and, for example, a driver's door, a disproportionate stress can be exerted on the motor vehicle latch in a Y-direction in the case of accident. The locking mechanism of the motor vehicle latch is also stressed in a y-direction and is preferably parallel to the latch plate, and also parallel to the locking mechanism. In particular during stressing of the motor vehicle latch in a direction parallel to the latch plate or parallel to the locking mechanism the splay has a stabilizing effect on the motor vehicle latch in the end area of the latch plate opposite the inlet slot.

In one embodiment of the invention, the splay is formed in the direction of the catch and the pawl. A splay in the direction of the locking mechanism or the locking mechanism components is advantageous as the latch plate forms a screw mounting surface in the motor vehicle, for example, so that the motor vehicle chassis is opposite an even surface for mounting of the motor vehicle latch. Furthermore, it has become apparent that a splay advantageously increases resilience in the direction of the locking mechanism.

If the splay is formed in a direction against the arrangement of the catch and pawl on the latch plate, a further embodiment of the invention thus results. If the splay is formed against the locking mechanism on the latch plate, more space is thus present on the latch plate for movement of the locking mechanism components or further latch components. The splay has a positive effect on the free space of the moving parts of the latch. If, according to the invention, an end of the latch plate is referred to which has a splay the area of the latch plate is thus described which is opposite the infeed section end of the latch plate. The inlet area or the infeed section of the catch is the area in which the latch holder engages during closure of the latch. The end area of the latch plate opposite the inlet area is also subjected to extreme stress during tensile stress, for example, in the direction of the latch plate and thus, for example, in the Y direction of the latch plate. A semi-circular-shaped formation of the latch plate or the splay stabilizes the latch plate in the semi-circular formation, to the extent that the splay encompasses the inlet area of the latch holder in a semi-circular shape. Surprisingly, the semi-circular splay of the latch plate means that much greater stresses can be absorbed by the locking mechanism.

If the splay runs at least around a mounting opening, a further embodiment of the invention thus results. Additional stabilization occurs when the splay encompasses a mounting opening. Mounting opening hereby means the area which holds the latch in the motor vehicle. A mounting opening can be a thread opening molded into the latch plate, for example, but can also only be an opening behind which a thread is mounted. A mounting opening thus forms a force-fitting and/or form-fitting connection between the latch plate and the motor vehicle chassis. If the splay is provided for in the area of the latch plate in which a mounting opening is provided in the latch plate, the splay supports and/or stabilizes not only the latch plate and the locking components mounted or arranged on the latch plate, but has an additional stabilizing impact on the motor vehicle latch. Encompassing hereby means that the semi-circular shape of the splay runs into an area of the mounting opening or extends around an area of the mounting opening. The splay preferably forms a circumferential end, at least in the end of the latch plate opposite the inlet area of the latch holder.

An advantageous embodiment of the invention results if the splay extends from a mounting opening up to an area of an end of the latch plate opposite the latch holder. The latch plate is in essence of a flat design. The latch plate has a front end in an opposite direction to the latch holder in which the inlet slot is present so that the latch holder can engage with the locking mechanism. This front end is opposed to the latch holder and preferably forms a straight end or a straight course which is only interrupted by the inlet slot. According to the invention, the splay can extend at least unilaterally to the front area, i.e. to the straight edge of the latch plate so that the splay ends in the front area of the latch plate crucially with the front edge of the latch plate. In this case, the splay extends at least unilaterally to the front area of the latch plate, wherein a further end of the splay can also end at an end of the latch plate, wherein this further end of the splay does not need to concur with the front edge of the latch plate. The mounting opening is also braced by the extension of the splay into an area of the mounting opening. This thus increases the stability of the latch plate on the one hand and both the latch plate and the splay can be additionally stabilized by the mounting opening. In the area of the latch plate reinforced by the splay and the mounting opening, increased stability thus results which can support an especially highly stressed area of the latch plate, for example. For example, the mounting opening can be a mounting opening arranged in the area of the locking mechanism or a bearing point of the locking mechanism.

If the catch interacts with a latch holder, with the catch and the pawl securing the latch holder in a closure position of the motor vehicle, at least in a main ratchet position and with a connecting line of two mounting openings running behind an area of the latch holder engaged with the catch viewed from the inlet slot, a further embodiment of the invention thus results. As a connecting line the line between two mounting openings in the latch plate is considered here, with the mounting openings being inserted into the latch plate such that a line extending from the center points of the mounting openings via the latch plate forms a connecting line which extends via the latch plate. The connecting line extends between the two mounting openings and beyond the inlet slot. The latch holder is held by the locking mechanism in the closed state of the locking mechanism and firmly positioned, the engagement area of the latch holder into the locking mechanism lying behind the connecting line viewed from the front end of the latch plate. This means that the catch encompasses the latch holder or the locking bolt and the area of the latch holder encompassed by the catch lies behind this connecting line viewed from the front edge of the latch plate.

The arrangement of the locking bolt or the area of the latch holder in the closed state of the locking mechanism behind the connecting line gives the advantage that an optimized force transmission into the latch plate can take place. In particular in this case, the splay has a stabilizing effect on the latching system comprising the latch holder and the motor vehicle latch. If a tensile stress is exerted in the Y-direction on the motor vehicle latch by the latch holder, for example, the latch holder thus acts directly on the locking mechanism. Preferably, in such an arrangement at least also the catch axis lies behind the connecting line of the two mounting openings. By means of the arrangement of the catch axis and the engagement area of the latch holder behind the connecting line, a force application by the latch holder on the motor vehicle latch results therein that the latch plate folds up or kinks via the connecting line. This kinking or deformation of the latch plate is in an advantageous manner prevented by the splay encompassing the latch plate in a circular shape. If the pawl axis also lies in front of the connecting line, starting from a front area of the latch plate, an extremely stable closure unit can thus be formed.

In a further embodiment, a mounting surface is formed symmetrically for the catch, the pawl and the mounting opening. Symmetrical means that the area for mounting of the catch axis and the pawl axis are arranged in a plane and that the latch plate is located symmetrically from a front end to the splay at the rear end in a plane. A front end of the latch plate is described as the end which has the inlet slot for the latch holder and a rear end of the latch plate is at least the area opposite the inlet slot. This opposition preferably relates to an area of the inlet slot of the latch plate as the splay extends circumferentially and semi-circularly around the latch plate, it is thus naturally possible for the splay to also run into a front area of the latch plate. The symmetrical formation of the mounting area enables cost-effective production and a structurally simple solution is created. Furthermore, the latch plate can easily be adapted to the chassis of the motor vehicle.

In a further embodiment of the invention the mounting surface has at least a corrugation. In addition to the splay as a means of increasing stability, corrugations, i.e. indents in the latch plate can additionally increase stability of the motor vehicle. Furthermore, it is advantageous if the corrugation is inserted into the mounting surface in an arch-shaped manner. If the corrugation runs along the splay, for example, additional stabilization of the latch plate can thus be attained. However, the corrugations can also be arranged by an mounting point of the rotational axis of the locking mechanism components in places. A possibility is thus given to stabilize the motor vehicle latch and in particular the latch plate with little structural effort and also low manufacturing costs.

If the splay has a uniform or at least a roughly uniform radius, a further embodiment of the invention thus results. A uniform radius or a crucially uniform radius of the splay is cost-effective to manufacture and uniform load distribution or increased stability over the entire latch plate can also be attained.

BRIEF DESCRIPTION OF DRAWINGS

The invention is described in further detail below with reference to the attached drawings on the basis of the preferred embodiments. However, the principle applies that the exemplary embodiment does not restrict the invention but only constitutes an advantageous embodiment. The characteristics depicted can be executed individually or in combination, individually or in combination with other characteristics of the description, as also the patent claims.

The following are shown.

DETAILED DESCRIPTION

Figure 1:
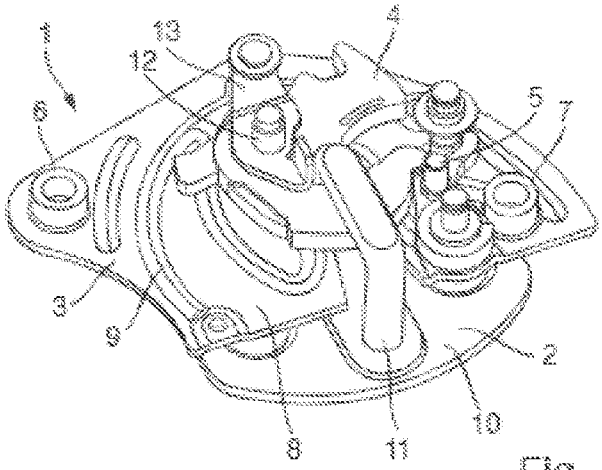
Fig. 1 PRIOR ART
FIG. 1 a three-dimensional view of an only partly illustrated motor vehicle latch engaged with a latch holder according to the state of the art, FIG. 2 a three-dimensional view of an only partly illustrated motor vehicle latch engaged with a latch holder according to the invention, FIG. 3 in the upper section a top view of an only partly illustrated motor vehicle latch engaged with a latch holder according to the state of the art with tensile stress and in the lower area a tension-expansion characteristic curve according to the tensile stress exerted, the force progression being reproduced in a pre-ratchet position, FIG. 4 A top view of an only partly illustrated motor vehicle latch in a main ratchet position under tensile stress with a latch holder, according to a motor vehicle latch from the state of the art and the pertaining tension-expansion curve, FIG. 5 in the upper area a top view of a motor vehicle latch according to the invention in a pre-ratchet and under tensile stress by means of a latch holder and in the lower area a pertaining tension-expansion curve, and FIG. 6 in the upper area a three-dimensional view of an only partly illustrated motor vehicle latch in a main ratchet according to the invention with engagement with a latch holder and in the lower area a graph which reproduces the tension-expansion course under tensile stress.

FIG. 1 shows a three-dimensional view of an only partly illustrated motor vehicle latch 1 in a main ratchet position engaged with a latch holder 2. A latch plate 3 is apparent on which a catch 4 and a pawl 5 are rotatably mounted. Furthermore, the latch plate 3 encompasses mounting openings 6, 7 and corrugations 9 extending over the circumference and the mounting surface 8. The locking mechanism is hereby formed from the catch 4 and the pawl 5 which are engaged with one another, the main ratchet position of the locking mechanism being reproduced in FIG. 1. The latch holder 2 has a base plate 10 and a latch holder bracket 11. A supporting metal sheet is also connected to the catch 4 or the catch axis 12 which ensures stabilization of the catch axis 12. FIG. 1 shows a theoretical construction of a motor vehicle latch, with only the crucial components for explanation of the function of the invention being reproduced.

Figure 2:
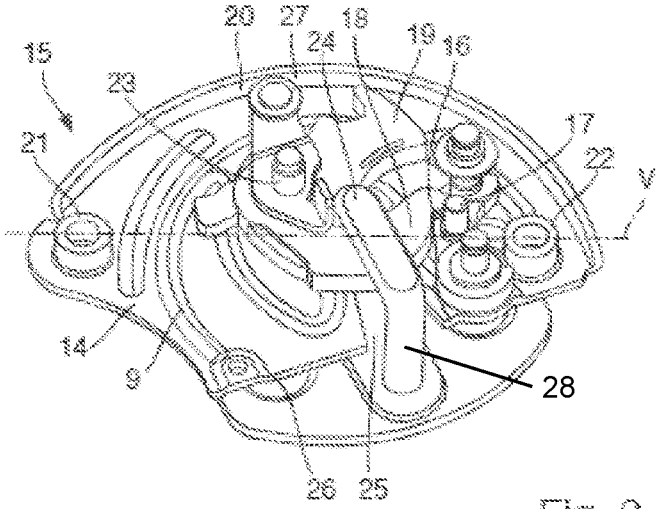

A latch plate 14 according to the invention is reproduced in a three-dimensional view in FIG. 2. Further components of the motor vehicle latch correspond in their construction to the construction shown in the state of the art. A motor vehicle latch 15 in a main ratchet position 16 is thus reproduced in FIG. 2, the pawl 17 engaging with the load arm 18 of the catch 19 and blocking the rotational movement of the catch 19. The latch plate 14 has a splay 20 which extends around the latch plate 14 in a semi-circular shape.

A connecting line V which connects both central points of the mounting openings 21, 22 extends beyond the latch plate 14. It is apparent that on the one hand the catch axis 23 and on the other hand the latch holder arm 24 of the latch holder 28 are located on one side of the connecting line V in which the start of the inlet slot 25 is also located. This front area is hereby distinguished from a rear area, an area behind the connecting line V in which the catch axis 23 and the latch holder arm 24 are located. The splay 20 is also crucially arranged behind the connecting line V, i.e. the splay is located with its components which are crucial to the invention behind the connecting line V. The front edge 26 preferably forms a straight line which is interrupted by the inlet slot 25.

The rear area 27 of the latch plate 14 is limited by the splay 20.

Figure 3:
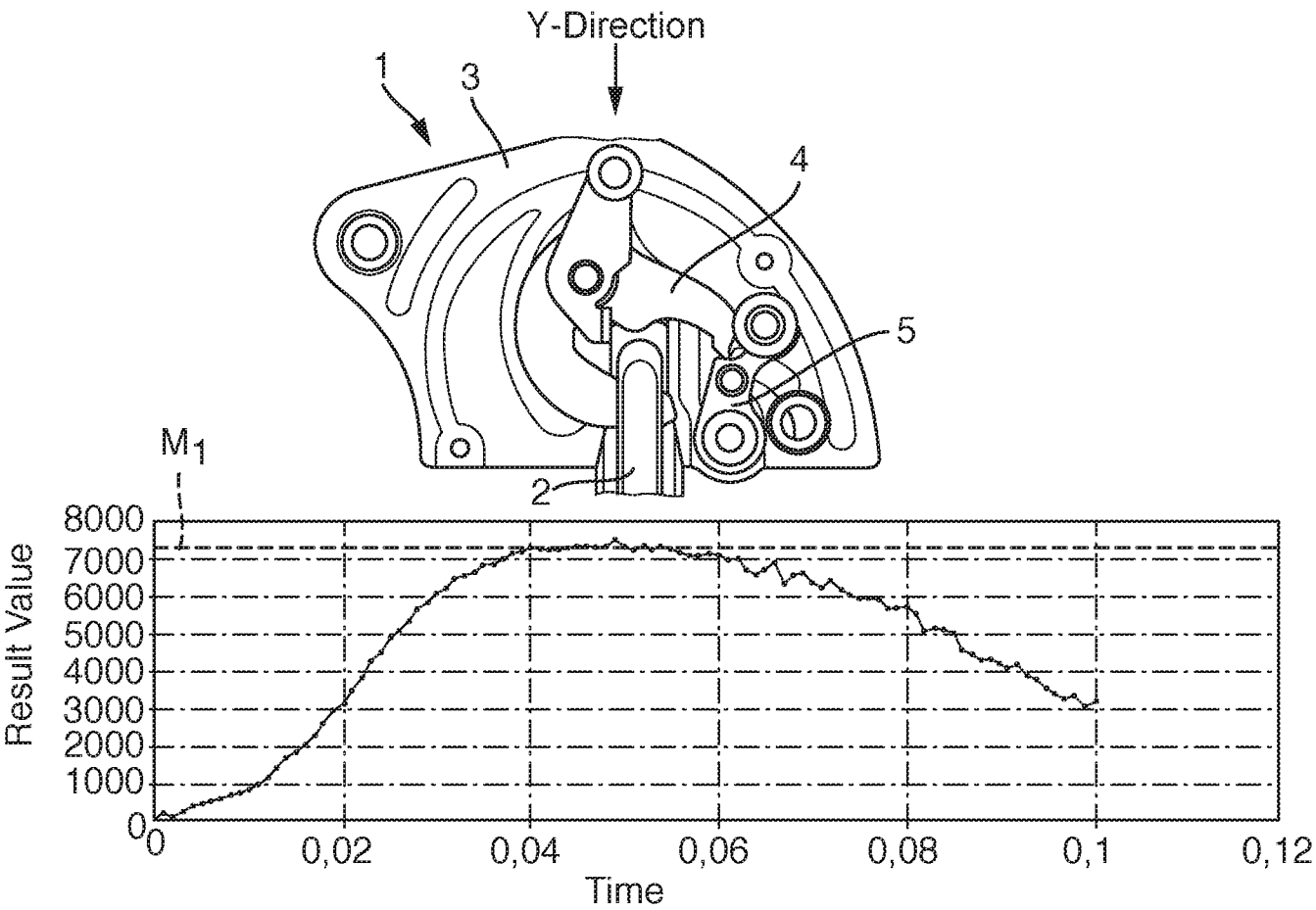

A latch plate 1 according to the state of the art is shown in the upper section of FIG. 3. The catch 4 is engaged with the pawl 5, the arresting arm of the catch 4 engaging with the pawl 5. In this pre-ratchet position, the latch holder 2 is already held by the locking mechanism consisting of the catch 4 and the latch holder 5 and must have sufficient stability according to the safety requirements 6 of the automotive industry. Stability hereby means that between the motor vehicle latch 1 and the latch holder 2 a relative force in the Y direction needs to be able to be absorbed. This sufficient stability of the latch 1 is verified in a tensile test.

In the lower section of FIG. 3, a tension-expansion course is reproduced until failure of the motor vehicle latch 1. The x-axis hereby describes the temporal course and the y-axis the force exerted. The maximum value after which failure of the motor vehicle latch occurs is of approximately 7.3 kN tensile load in a Y direction. The maximum value MI is sketched into the diagram here and was attained after approximately 0.0045 s. It involves a near-static tensile test in which speeds of 5 mm/min are usually used.

Figure 4:
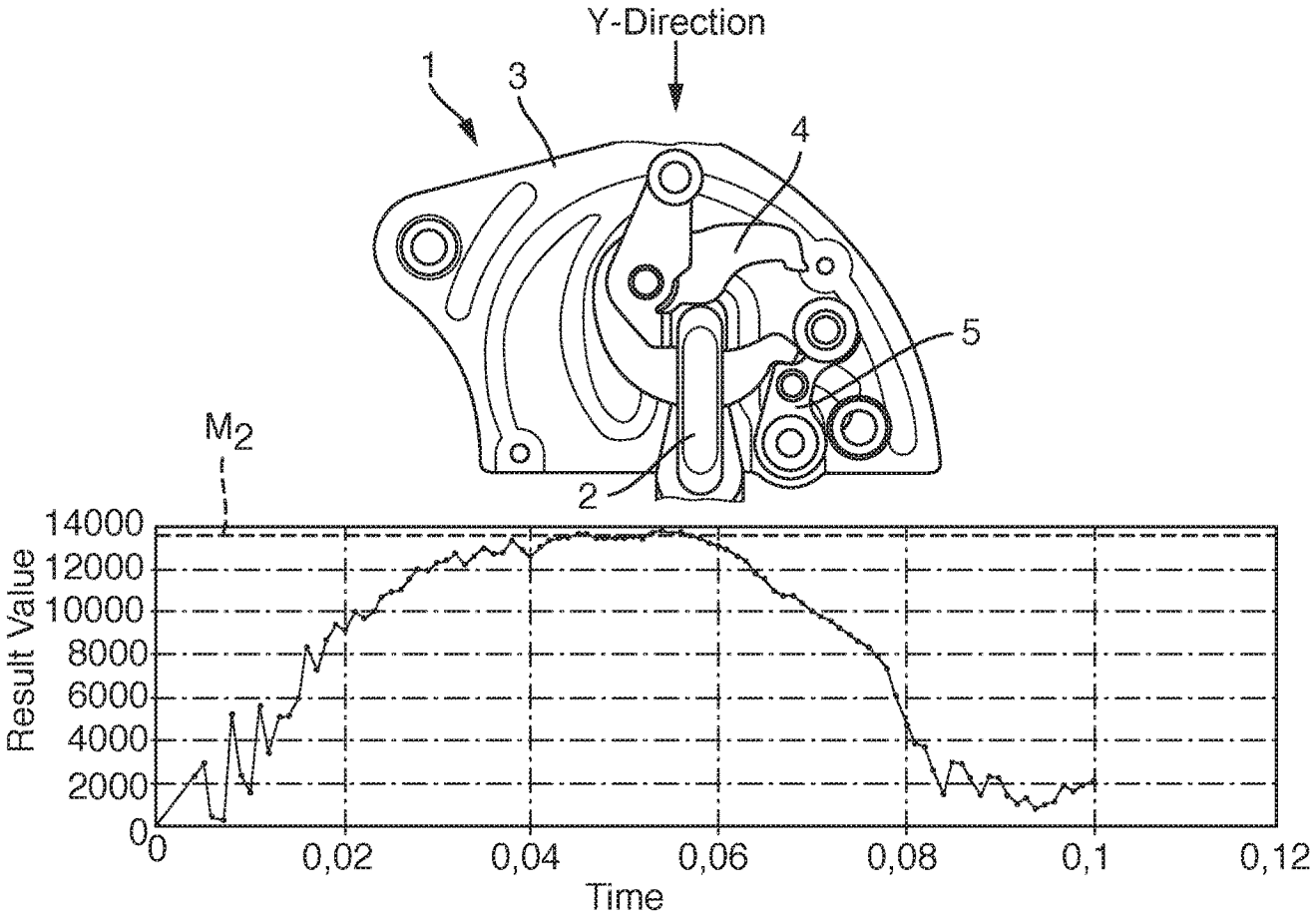

The motor vehicle latch 1 according to the state of the art is in turn shown in FIG. 4 in the upper figure, whereby the catch 4 and the pawl 5 are in a main ratchet position. The latch holder 2 has been completely moved into the latch plate 3 and is held in position by its locking mechanism consisting of a catch 4 and a pawl 5. The latch 1 was acted on by a force in a Y direction in turn, i.e. the transverse direction to the motor vehicle, provided that the motor vehicle latch 1 is a lateral door, in the transverse direction of the motor vehicle. A maximum value M2 of approximately 13.6 kN was attained after approximately 0.05 s before failure of the motor vehicle latch 1 occurred.

Figure 5:
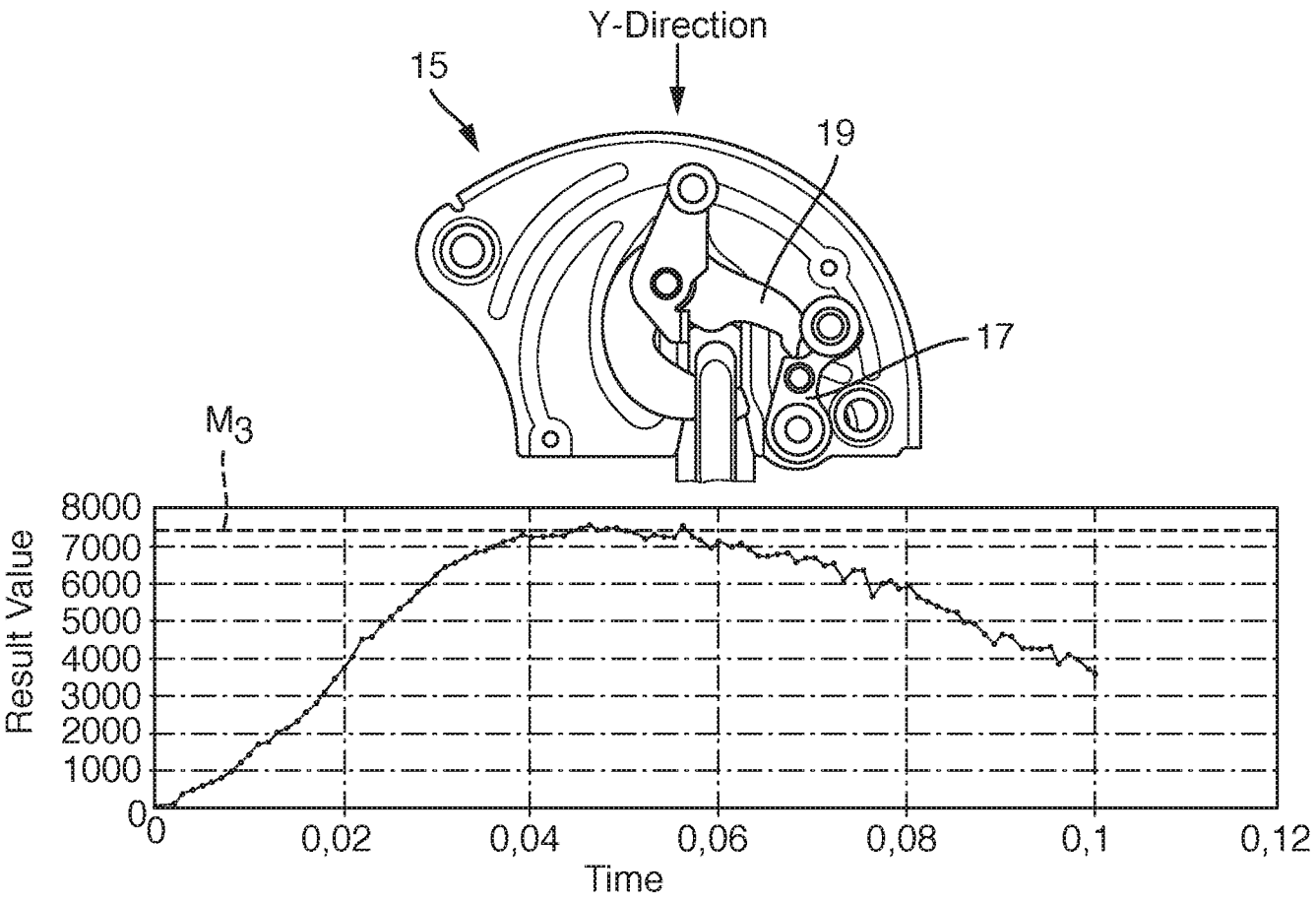

In FIG. 5, in the upper section of FIG. 5 a motor vehicle latch 15 is reproduced in turn according to the invention. The pre-ratchet position is illustrated, whereby the catch 19 engages with the pawl 17. However, the motor vehicle latch 15 is not yet completely closed. The motor vehicle latch 15 was also acted on in turn with a stress in the Y direction, whereby a maximum value M3 of 7.4 kN was attained before the motor vehicle latch 15 failed.

Figure 6:
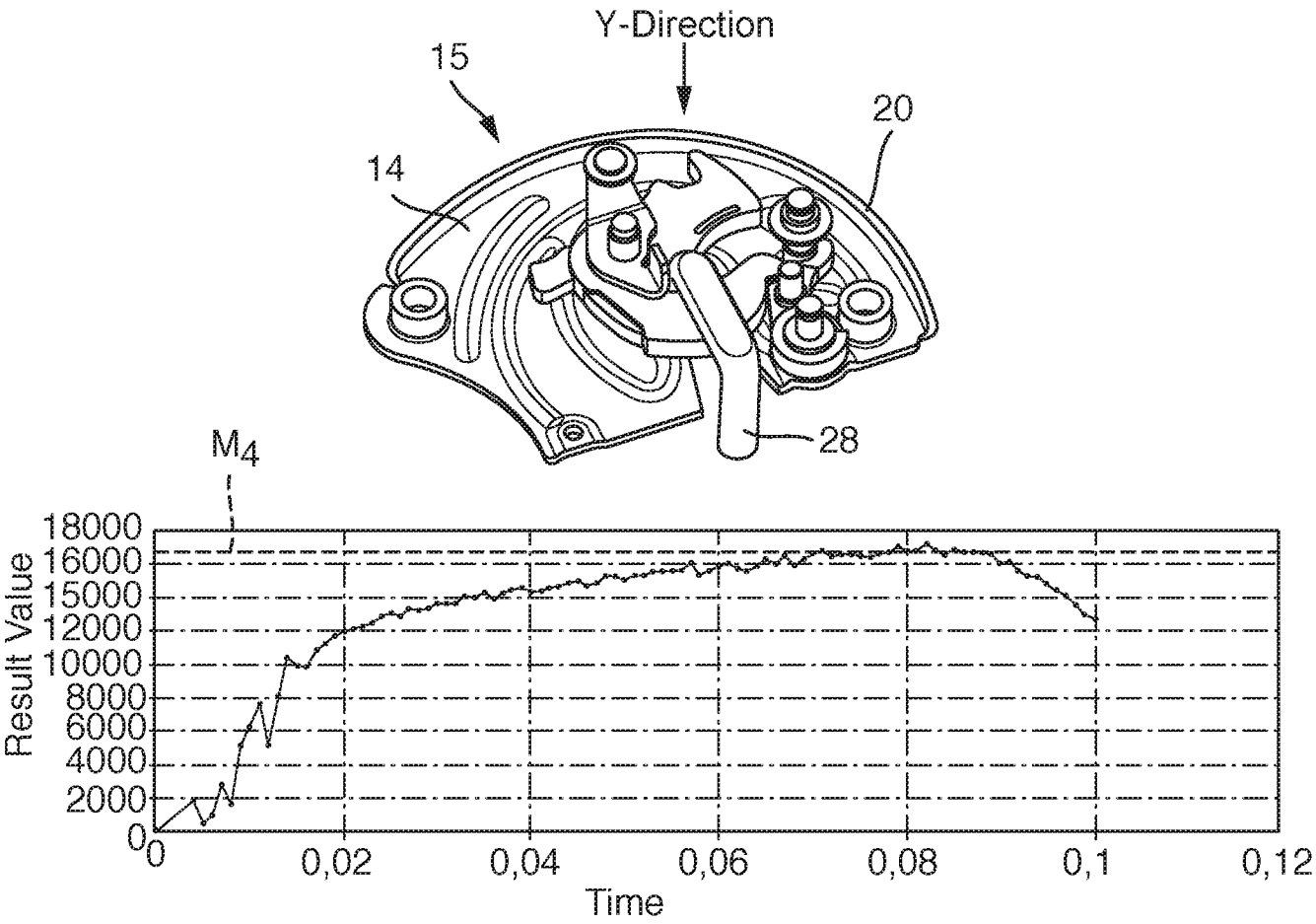

In FIG. 6 in the upper section of FIG. 6 the motor vehicle latch 15 is reproduced in a three-dimensional view in a main ratchet position. The motor vehicle latch 15 was in turn acted on in a Y direction, i.e. parallel to a plane of the latch plate 14 and in the direction of the latch holder 28 with tensile stress. A maximum value M4 of 16.7 kN could be determined before failure of the motor vehicle latch 15 occurred. In an identical construction of the further latch components solely due to the splay 20 on the latch plate 14 the stability of the motor vehicle latch 15 could thus be significantly increased.

If failure of a motor vehicle latch 1 according to the state of the art already occurred at tensile stresses of 13.6 kN, during failure of the motor vehicle latch 1 according to the state of the art it could be ascertained that the area behind the connecting line V bent upwards so that failure of the motor vehicle latch 1 ultimately occurred. This bending of the latch plate 3 according to the state of the art could be prevented with a latch plate 14 according to the invention which had a splay 20. As is clearly apparent from FIGS. 2 and 6, the splay 20 extends in a semi-circular shape around the latch plate 14 and encompasses the mounting opening 22.

LIST OF REFERENCE SYMBOLS

1 Motor vehicle latch
2 Latch holder
3 Latch plate
4 Catch
5 Pawl
6, 7 Mounting openings
8 Mounting surface
9 Corrugations
10 Base plate
11 Latch holder bracket
12 Catch axis
13 Supporting sheet metal
14 Latch plate
15 Motor vehicle door latch
16 Main ratchet position
17 Pawl
18 Load arm
19 Catch
20 Splay
21,22 Mounting openings
23 Catch axis
24 Latch holder arm
25 Inlet slot
26 Front edge
27 Rear area
28 Latch holder
V Connecting line
M Maximum value

The invention claimed is:

1. A motor vehicle latch comprising:
a catch,
a pawl, and
a latch plate,
the catch and the pawl being pivotably mounted on the latch plate,
the latch plate having at least two openings for mounting of the motor vehicle latch,
the latch plate having an inlet slot for a latch holder and a splay opposite the inlet slot being provided for on the latch plate, the splay being formed as an extension of the latch plate,
wherein the splay has at least a semi-circular end area opposite the inlet slot, and
wherein the two openings are positioned opposite to each other so that a connecting line extends between the two openings over the latch plate, wherein the semi-circular end area of the splay starts at a first end that is arranged adjacent a first circumference of one of the two openings and extends to a second end of the splay that is arranged adjacent to a second one of the two openings over an end of the latch plate that is oriented opposite to the latch holder, the second end of the splay extending beyond a second circumference of the second one of the two openings.

2. The motor vehicle latch according to claim 1, wherein the splay is formed in the direction of the catch and the pawl.

3. The motor vehicle latch according to claim 1, wherein the splay is formed in a direction against the arrangement of the catch, and the pawl on the latch plate.

4. The motor vehicle latch according to claim 1, wherein the splay at least runs around one of the at least two openings.

5. The motor vehicle latch according to claim 1, wherein the splay extends from at least one of the at least two openings into an area of an end of the latch plate directed opposite the latch holder.

6. The motor vehicle latch according to claim 1, wherein the catch interacts with the latch holder, whereby the catch and the pawl secure the latch holder in a closure position of the motor vehicle latch, at least in a main ratchet position and a connecting line of the at least two openings running behind an area of the latch holder engaged with the catch viewed from the inlet slot.

7. The motor vehicle latch according to claim 1, wherein the catch, the pawl and the mounting openings are mounted symmetrically on the latch plate.

8. The motor vehicle latch according to claim 1, wherein the latch plate has at least a corrugation.

9. The motor vehicle latch according to claim 8, wherein the corrugation is inserted in an arch-shaped manner into the latch plate.

10. The motor vehicle latch according to claim 1, wherein the splay has a uniform radius.

11. The motor vehicle latch according to claim 1, wherein the at least two openings are formed on opposite sides of the inlet slot.

12. The motor vehicle latch according to claim 1, wherein the inlet slot extends in a direction that is transverse to the region oriented opposite to the latch holder.

* * * * *